United States Patent [19]

Johne et al.

[11] 3,946,669

[45]*Mar. 30, 1976

[54] PRINTING ARRANGEMENT ALTERNATIVELY OPERATED FOR ONE-SIDE PRINTING AND TWO-SIDE PRINTING WITH CONTROL SYSTEM THEREFOR

[75] Inventors: Albrecht Johne; Karl-Heinz Förster, both of Dresden; Klaus Schanze, Radebeul, all of Germany

[73] Assignee: Veb Polygraph Leipzig Kombinat fur Polygraphische Maschinen und Austrustungen, Leipzig, Germany

[ * ] Notice: The portion of the term of this patent subsequent to June 25, 1991, has been disclaimed.

[22] Filed: Nov. 9, 1973

[21] Appl. No.: 414,536

Related U.S. Application Data

[63] Continuation-in-part of Ser. No. 258,078, May 30, 1972, abandoned.

[52] U.S. Cl. ..... 101/230; 101/183; 271/186

[51] Int. Cl.[2] ..... B41F 5/02; B41F 5/16

[58] Field of Search ..... 101/230, 232, 183, 184; 271/186

[56] References Cited

UNITED STATES PATENTS

| | | | |
|---|---|---|---|
| 3,264,916 | 8/1966 | Owen | 209/74 R |
| 3,343,672 | 9/1967 | Vries et al. | 271/64 X |
| 3,654,861 | 4/1972 | Rudolph et al. | 101/230 |

*Primary Examiner*—J. Reed Fisher
*Attorney, Agent, or Firm*—Michael J. Striker

[57] ABSTRACT

In first and second modes, the arrangement prints on only one side or on both sides of a sheet, respectively. A sheet is transported along a predetermined path through the arrangement and passes printing devices cooperating to effect printing of the sheet. Change-overs from one to the other mode alter a portion of the sheet transport path, changing its length. A control system for the arrangement includes a shift register. When a sheet arrives at a predetermined location along the path, a sheet-representing signal is applied to the shift register. Shifting pulses applied to the shift register in synchronism with sheet travel cause the sheet-representing signal to travel through the shift register in simulation of sheet travel. As the sheet-representing signal reaches preselected shift-register stages, it causes an actuator associated with such stage to actuate a respective printing device. Thus, the printing devices are controlled in dependence upon the arrival of the sheet at predetermined portions of the path. Upon a change of operating mode, a compensating unit is operable for at least partially offsetting changes in the correlation between shift register stages of the shift register and the associated portions of the path.

15 Claims, 7 Drawing Figures

PRINTING ARRANGEMENT ALTERNATIVELY OPERATED FOR ONE-SIDE PRINTING AND TWO-SIDE PRINTING WITH CONTROL SYSTEM THEREFOR

CROSS-REFERENCE TO RELATED APPLICATION

This is a continuation-in-part of the commonly owned copending application Ser. No. 258,078, filed May 30, 1972, now abandoned.

BACKGROUND OF THE INVENTION

The present invention relates specifically to problems in the control of printing arrangements capable of operation in both one-side and two-side printing modes.

More specifically, the invention relates to problems in the control of printing arrangement of the aforementioned kind wherein changing back and forth between the one-side and two-side printing modes involves an alteration in the path of the travel of a sheet to be printed through the printing arrangement with a concomitant change in the length of such path. By way of example, in some printing arrangements, two printing stations are provided, each adapted during operation to print a different image. In the one-side printing mode, a sheet is transported through the printing arrangement along a predetermined path past the first printing station and is printed upon a first side thereof, and is then transported past the second printing station and printed again upon the same side thereof, for example so as to form a two-color image. In the two-side printing mode, the sheet is transported past and printed at the first printing station in the manner just mentioned; however, before the sheet reaches the second printing station it is flipped over or in some other manner detoured in such a way that upon arrival at the second printing station the hither to unprinted side of the sheet will be presented to the printing station and the hitherto unprinted side of the sheet will be printed, so that after passing both printing stations both sides of the sheet will have been printed. Usually, with such two-mode printing arrangements, it is desired to control the operation of various printing devices in the printing arrangement, such as offset rollers, dampening arrangements, etc., in a manner synchronized with the transport of the sheet to be printed through the printing arrangement. However, this kind of synchronization is made difficult by the presence of two operating modes, inasmuch as changeovers back and forth between the two operating modes involve alterations in one or more portions of the path of travel of the sheet with a concomitant change in the overall length of such path of travel. The result is a loss of correlation between specific portions of the path of travel and any timing or sequencing control circuitry associated with printing devices to be actuated when the sheet reaches certain specific portions of the path of travel.

SUMMARY OF THE INVENTION

It is the general object of the present invention to provide a printing arrangement capable of operating in at least one-side and two-side printing modes, together with a control system for timing and sequencing the operations of the various operations of the various components and devices of the printing operation in proper relationship relative to the travel of a sheet to be printed through the printing arrangement.

It is in particular an object of the invention to provide such an arrangement and control system therefor which overcomes the aforedescribed difficulties.

More specifically still, it is the object of the invention to provide such an arrangement and control system wherein changes of operating mode such as cause alterations in one or more portions of the path of travel of sheets through the printing arrangement and concomitant changes in the length of such path of travel, are suitably offset and compensated so as to maintain a satisfactory correlation between the passage of sheets to be printed through the printing arrangement and the correct sequencing and timing of the operations of the various components and printing devices of the printing machine.

These objects, and others which will become more understandable from the following description of specific embodiments, can be met according to one advantageous concept of the invention by providing a printing arrangement operative in a first mode for printing on only one side of a sheet and operative in a second mode for printing on both sides of a sheet, with drive means for effecting transport of a sheet to be printed along a predetermined path through the printing arrangement. The printing arrangement is comprised of a plurality of printing devices cooperating to effect printing of a sheet passing along said path. The printing arrangement includes means for effecting a changeover from one to the other of the two printing modes in a manner altering a portion of and changing the length of said path. The printing arrangement is provided with a control system including a shift register having a plurality of shift register stages and having a shifting pulse input for receipt of shifting pulses and having an information signal input for receipt of information signals. When a sheet to be printed arrives at a predetermined location of said path a predetermined signal is applied to the information signal input of the shift register. Shifting pulse generating means synchronized with the sheet transport means is operative for applying to the shifting pulse input of the shift register a train of synchronizing shifting pulses causing said predetermined signal to be registered by successive ones of said shift register stages in synchronism with the travel of the sheet along said path. A plurality of actuating means is provided, each associated with and controlling the operation of a respective one of said printing devices and each connected to a respective one of the shift register stages and each operative for actuating the respective printing device in response to the arrival of said predetermined signal at the respective shift register stage so as to control the operation of the respective printing device in a manner correlated with the arrival of the sheet to be printed at the portion of said path associated with the respective shift register stage. Compensating means is provided for at least partially offsetting changes in the correlation between shift register stages of said shift register and the associated portions of said path resulting from a change of operating mode.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
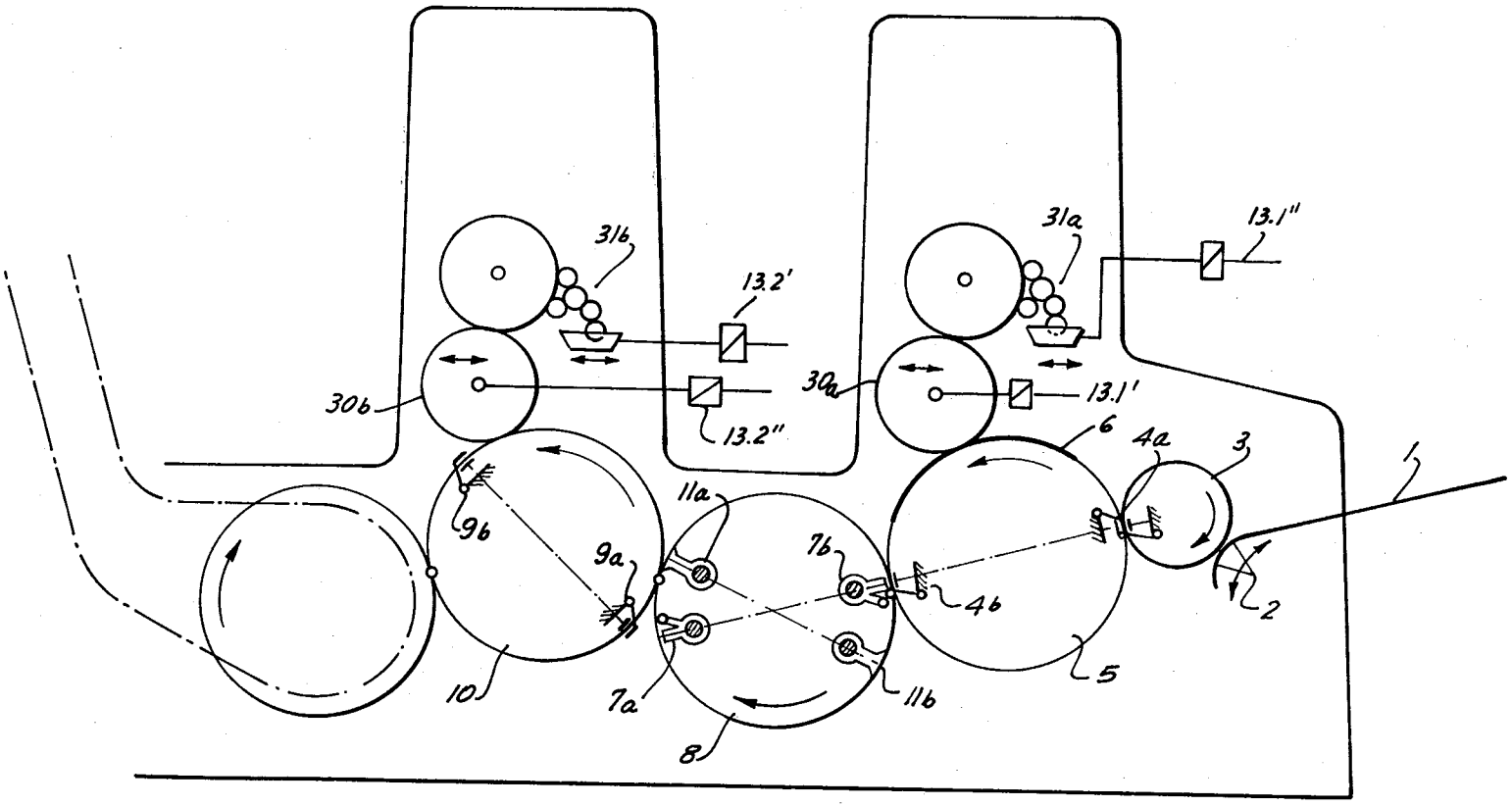
FIG. 1 is a schematic illustration of a printing arrangement.

FIG. 1 illustrates in schematic manner a printing machine adapted for alternative operation in one-side and two-sie printing modes. Machines of this type are per se conventional. In the machine depicted in FIG. 1, sheets are fed onto a feed table 1 from a non illustrated conveyor stage located upstream of such location, and pass between a gripper area 2 of the feed table 1 and a first guide drum 3 which is provided on its circumferential surface with a conventional gripper device which engages the leading end of the entering sheet. The roller 3 turns in the indicated direction and carries the sheet with it. When the leading edge of the sheet 6 reaches the zone of tangency between rollers 3 and 5, a gripper 4*a*, which may for instance be a suction gripper, grips the leading edge of the sheet and causes the sheet to be transferred onto the second or printing roller 5, with the sheet travelling in the direction indicated for the direction of rotation of printing roller 5. The outwardly facing surface of the sheet contacts an offset printing roller 30*a* which transfers an image onto the sheet 6. The printing cylinder 5 continues to turn. When the leading edge of the sheet 6 enters the region of tangency between the rollers 5 and 8, such leading edge is engaged by a gripper device 7*b* (as shown in FIG. 1), whereafter the sheet is transferred by the transfer roller 8 to the second printing cylinder 10.

Specifically, when the leading edge of the sheet 6 reaches the point of tangency between the rollers 8 and 10, one of the two gripping devices 9*a*, 9*b* on second printing roller 10 engages the leading edge of the sheet, and the sheet 6 thereupon travels on the circumference of the second printing roller 10. The already printed surfaces of the sheet 6, while travelling on second printing roller 10 faces outwardly, and is printed upon again by the second offset printing roller 30*b*. Thus two images are printed upon a single side of the sheet 6.

Alternatively, the printing machine of FIG. 1 can be made operative to print one image on one side of the sheet 6 and another image on the other side of sheet 6. In this mode of operation, the printing and processing of sheet 6 proceeds in the manner described above, up to the time of transfer of the sheet 6 from the first printing roller 5 to the transfer roller 8. Instead of the leading edge of the sheet 6 being gripped by gripper 7*b*, the trailing edge of the sheet 6 is gripped by the gripping device 11*b*. The gripping device 11*b*, in known manner, transfers the gripped trailing edge of the sheet 6 to the gripping device 7*b*, and the sheet 6 is "flipped over" in the course of its transfer from first printing roller 5 to transfer roller 8. This flip-over from the first printing roller 5 to the transfer roller 8 is per se conventional, and is for example disclosed in detail in commonly owned U.S. Pat. No. 3,654,861. The entire disclosure of U.S. Pat. No. 3,654,861 is incorporated herein by reference, and especially for details of the "flip over" action. The similarity between the drawing of U.S. Pat. No. 3,654,861 and that of the present invention is so great as to make clear how the flip over occurs in the machine illustrated herein.

In any event, after the sheet 6 has been flipped over in the manner described in U.S. Pat. No. 3,654,861, it is transferred onto second printing cylinder 10 and thereafter printed and processed in the same manner as described previously. However, as a result of the flipping over of the sheet 6, during its transfer from first printing roller 5 to transfer roller 8, the side of sheet 6 engaged by second offset roller 30*b* is not the side of sheet 6 engaged by first offset roller 30*a*. Consequently, both sides of the sheet 6 are printed, one side being printed at the first printing station and the second side being printed at the second printing station.

The rollers 5, 8 and 10 are driven in synchronism, and therefore the relative orientations which they assume are repeatedly assumed, once per rotation. Consequently in the one-side-printing operational mode, the gripper unit 4*b* on first printing roller 5 will repeatedly pass into tangency with the gripper unit 7*b* on the transfer roller 8, this occurring once per rotation of rollers 5 and 8. The rollers 5 and 8 are driven with such a phase shift relative to each other that the gripper 4*b* repeatedly passes into tangency to the gripper 7*b*, as just mentioned.

In the other mode of operation, wherein one image is printed on one side of sheet 6 and another image is printed on the other side of sheet 6, the roller 5 and 8 will likewise be driven in synchronism, and in the present embodiment with the same rotational frequency. However, the phase shift between the rollers will evidently be different. The orientations of the rollers 5 and 8 must in this second mode be such that, once per rotation of the rollers 5 and 8, the gripper 11b on roller 8 moves into tangency with the trailing edge of the sheet 6 being carried by first printing roller 5, Evidently, if one changes over from the one-side printing mode to the two-side printing mode, then one of the rollers 5 and 8 will have to be turned relative to the other of the rollers 5 and 8 by a certain angle. This angle in the illustrated embodiment will be equal to the angular displacement between the gripper units 11*b* and 7*b* on roller 8, plus the angular extension of the sheet 6 when riding on the circumferential periphery of roller 5. The angular displacement between gripper units 11*b* and 7*b* on roller 8 is evidently a constant for a particular roller 8. However, the angular extension of the sheet 6 will depend upon the length of the sheet. Evidently, if the machine is used to handle only one size of sheets, the angular adjustment of rollers 5 and 8 relative to each other when changing back and forth between the two printing modes will always be the same. However, if changes of sheet length are involved, then the adjustments in the relative orientations of the rollers 5, 8 will vary in dependence upon the length of the sheet being printed.

Figure 1A:
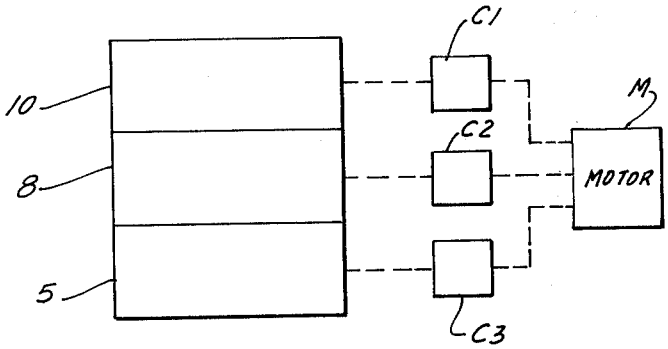
FIG. 1*a* is a schematic illustration of the connection between certain portions of the printing arrangement of FIG. 1 and the drive means therefor.

The manner in which the orientations of the various printing and conveying rollers 5, 8 and 10 are adjusted will be understood from FIG. 1*a*. The rollers 5, 8 and 10 are there depicted. It will be seen that these three rollers are all driven by a common drive motor M. However, each of the rollers 5, 8 and 10 is connected to the output shaft of drive motor M through a disengageable clutch C1, C2 or C3. When it is desired, for example, to effect an adjustment of the relative orientations of rollers 5 and 8, for the purpose of changing over from one-side to two-side printing, one or both of the clutches C2 and C3 will be disengaged, permitting free turning of the rollers 5 and/or 8 until they assume the proper relative orientation, as described above, whereupon the clutches associated with the rollers are re-engaged, and the drive motor M started anew.

In the illustrated embodiment, and for the purposes of explanation, it will be assumed that the adjustment in question is effected by maintaining the position of rollers 5 and 3, and by adjusting the positions of the rollers 8, 10, etc., i.e., the rollers downstream of the first printing roller 5.

It will be noted that in the machine shown in FIG. 1 there are provided at the two printing stations offset rollers 30*a* and 30*b*. The double-headed arrow at each offset roller indicates that the respective roller can be moved into and out of engagement with the respective printing roller 5 or 10. Such movement of the offset rollers 30*a*, 30*b* is effected by energizing or de-energizing a respectively associated electromagnetic moving arrangement. The electromagnet moving arrangement associated with offset roller 30*a* is designated 13.1'', and that associated with offset roller 30*b* is 13.2''.

Likewise, each printing station is provided with a respective dampening system 31*a*, 31*b* operative as a whole for appropriate dampening the offset rollers 30*a* and 30*b*. Each dampening system is movable from an operative position to an inoperative or disengaged position, under the influence of a respective electromagnetic moving means. The electromagnetic moving means associated with dampening arrangement 31*a* is designated 13.1', while that associated with dampening arrangement 31*b* is designated 13.2'.

If for any reason a sheet to be printed is not in fact present at one of the two printing stations, then evidently the dampening of the offset roller 30*a* or 30*b*, and/or the pressing of the offset roller 30*a* or 30*b* against the respective printing roller 5 or 10, is to be avoided, in order to prevent the application of an ink image onto the surface of the printing roller and/or the double dampening of the offset roller.

In order to properly control the operation of the offset roller and the dampening arrangement at each printing station, it is necessary to energize and de-energize the respective electromagnetic moving means in the proper sequence, at the proper times relative to the travel of a sheet through the printing machine, and in dependence upon whether a sheet is in fact present at the respective printing stations. To this end, an electronic control arrangement is provided.

Figure 2:
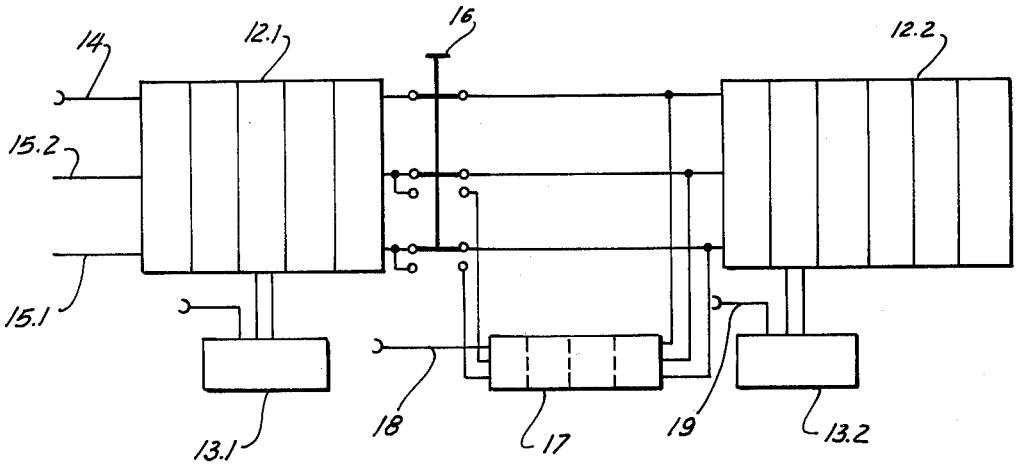
FIG. 2 illustrates a first control system according to the invention.

A first embodiment of an electronic control arrangement is depicted in FIG. 2. The basic component of this control arrangement is a shift register 12. The shift register is comprised of a first section 12.1, comprised of five bistable shift-register stages, and a second section 12.2 comprised of six bistable shift-register stages. The construction and operation of shift registers is per se too well known to require detailed discussion here.

The shift register 12 has an input 14 for the receipt of shifting pulses, and has two inputs 15.1 and 15.2 for the receipt of information signals, in conventional shift register fashion.

The illustrated shift-register control arrangement operates in the following manner:

A sheet is introduced into the printing machine. Upon its introduction into the machine, the presence of the sheet at such point of introduction is detected by suitable means, whether photoelectric, pneumatic, mechanical, or of other type. A signal is generated indicating the presence of a sheet at such point of introduction, and thereby indicating the introduction of a sheet into the printing machine. Conversely, when a sheet is not present at such point of introduction a signal indicative of such fact is likewise generated by the aforesaid (non-illustrated) detecting means.

The sheet detecting means has two outputs, respectively connected to the two information inputs 15.1 and 15.2 of the shift register 12 shown in FIG. 2. When the introduction of a sheet is detected, a signal is applied to input 15.1; otherwise, a signal is applied to input 15.2.

Figure 1B:
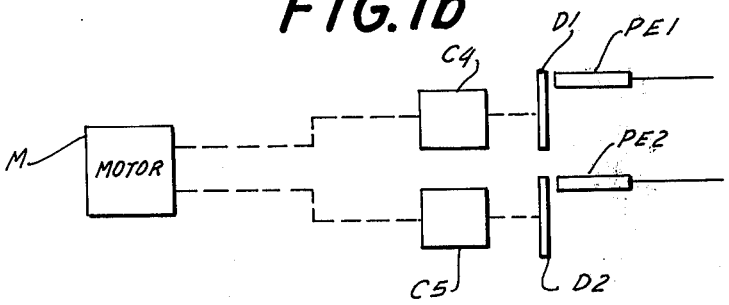
FIG. 1*b* is a schematic illustration of means for generating trains of shifting pulses in synchronism with the operation of the drive means of the printing arrangement.

Means is provided for generating shifting pulses in synchronism with the transport of the sheet through the printing machine, and for applying such shifting pulses to the shifting pulse input 14 of the shift register 12. One such synchronizing arrangement is schematically depicted in FIG. 1*b*, to which reference is made. Connected to the output shaft of drive motor M, which serves to drive the various rollers of the printing machine, are two synchronizing disks D1 and D2. These synchronizing disks D1, D2 are connected to the motor output shaft via respective disengageable clutches C4 and C5. The peripheral portions of the synchronizing disks D1, D2 are marked with circumferentially spaced synchronizing markings which are detected by respective photoelectric detectors PE1 and PE2. The markings on the disks D1 and D2 can be such that the pulse-repetition frequencies of the signals produced by the respective detectors PE1 and PE2 are the same, or related by an integral factor. The pulse trains produced by PE1 and PE2, if of equal frequency, can be in phase or out of phase, as desired, and the phase shift between the pulse trains can be adjusted by disengaging one or both of clutches C4 and C5, effecting relative movement between the disks D1 and D2 to an extent corresponding to the desired phase shift, and then re-engaging the respective clutch or clutches. The pulse train produced by only one of PE1 and PE2 can be used, or else both pulse trains can be employed.

In the particular embodiment illustrated, where the rollers 5, 8 and 10 happen to be of equal diameter and happen to be driven at the same rotational frequency, the markings on the synchronizing disks D1, D2 will be such that the time interval between successive synchronizing pulses produced by detectors PE1, PE2 will correspond to the time interval required for rollers 5, 8 and 10 to turn through an angle of 30°. Clearly, these numerical values are offered solely for purposes of explanation.

Upon introduction of a sheet 6 into the printing machine, a signal will be applied to information input 15.1 of shift register 12, and a synchronizing shifting pulse derived from PE1 will be applied to shifting pulse input 14 of the shift register. As a result, the first bistable stage of the shift register 12 will register the presence of a sheet at the point of introduction into the machine. By the time the illustrated rollers 5, 8 and 10 have turned through an angle of 30°, the introduced sheet will have been transported a certain corresponding distance through the machine, along its illustrated path. A second shifting pulse will be applied to the input 14 of shift register 14, and the signal hitherto stored by the first bistable stage of the shift register will be transferred to the second bistable stage thereof, indicating that the sheet should by now have reached the point along the path of travel associated with the second bistable stage of the shift register 12. If meanwhile no further sheet has been introduced into the printing machine, then at the time of such second shifting pulse, a signal will be registered by the first bistable stage of the register, indicating that no sheet is present at the location associated with the first bistable stage, i.e., that no sheet is present at the point of introduction into the machine.

It will be understood by those skilled in the art that the presence of the leading edge of a sheet is usually detected for the purpose of determining the arrival of a sheet at a particular location. However, the presence of a sheet can be detected in any conventional manner desired.

As the single sheet mentioned above passes through the printing machine of FIG. 1, the corresponding signal indicating the existence of that sheet will be transferred from one stage of the shift register 12 to the next, in synchronism with the travel of the sheet. When a sheet should be present at a particular location, based upon the determination that a sheet has been introduced at a certain time previously, signal indicating the assumed presence of a sheet will be registerd by that stage of the shift register associated with the location in question.

It is evident that if a single sheet is transported through the entire printing machine, with no other sheets being transported, the various operations performed by different functional groups in the printing machine must be performed in a predetermined time relationship relative to the travel of such sheet through the machine.

For example, after the sheet 6 has travelled a distance associated with 90° of rotation of the printing roller 5, it may for example be necessary to activate the dampening arrangement 31*a*. To assure that this occurs, a bistable interrogating stage 13.1 (FIG. 2) is connected to the third bistable stage of the shift register 12. Each bistable stage of the shift register has two outputs, and the two inputs of the bistable interrogating stage 13.1 are connected to the two outputs of the third shift register stage. One of the two outputs of bistable stage 13.1 may be connected, for example, to electromagnetic moving means 13.1″. Thus, when the sheet has travelled through the printing machine a distance corresponding to 90° of rotation of the rollers 5, 8 and 10, the signal which was entered into the shift register upon introduction of the sheet will have reached the third stage of the shift register, triggering bistable device 13.1 to that state thereof in which it energizes the moving means 13.1″ in order to activate the respective functional group of the first printing station.

It will be appreciated that other additional functional groups may be provided and controlled in similar manner. As the sheet travels through the machine, the signal corresponding to that particular sheet passes along the successive stages of the shift register, and if any particular functional group of the machine is to be actuated or deactivated upon the arrival of the sheet at such location, then a suitable bistable interrogating stage, like stage 13.1, can be connected to the respective stage of the shift register.

In FIG. 2, there is connected to the seventh shift register stage of register 12 a further bistable interrogating device 13.2, such as a conventional flip-flop, having two inputs connected to the corresponding two outputs of the seventh shift register stage and having one of its two outputs connected, for example, to the electromagnetic moving means 13.2″ associated with the offset roller 30*b* of the second printing station. When the sheet 6 has travelled through the machine a distance corresponding to 210° of rotation of the rollers 5, 8 and 10, the signal corresponding to that sheet will reach the seventh shift register stage and will effect actuation of the dampening arrangement 31*b*.

Further bistable interrogating stages, like 13.1 and 13.2, can be connected to which ever ones of the shift register stages correspond to the locations along the path of travel of the sheet at which the actuation of the respective offset rollers 30a and 30b should occur, to press them towards the respective printing cylinders 5 and 10 at the correct times.

It is to be noted that the bistable stages 13.1 can be simple two-input two-output flip-flops, or they can be gated bistable circuits provided with gating signal inputs 19 permitting them to be triggered by the shift register stages only when a gating signal is applied to the respective input 19 thereof.

It has already been explained that when the machine is changed over from one-side printing to two-side printing, and also when the length of paper employed with two-side printing is changed, an appropriate change must be made in the relative angular orientations of the two rollers 5 and 8. Such change is easy to implement, in the manner described with respect to FIG. 1*a*.

A more difficult problem resulting from such a changeover lies in the introduction of a phase shift between the several stages of the shift register 12 and the path locations which had corresponded to those shift register stages prior to such change of operating mode. For example, upon a changeover from one-side printing to two-side printing, it is evident that the total length of the path travelled by the sheet 6 will be increased by the circumferential distance between the two grippers 4*b* and 7*b* plus the length of the sheet 6 itself. Accordingly, as the shifting signals are applied to the input 14 of register 12, there will be a change in the correspondence between different locations of the path of travel of the sheet and the different shift register stages.

The present invention proposes several different solutions to the problem of compensating for the introduction of this phase shift.

Variation 1

Upon a changeover from one-side printing to two-side printing, button 16 in FIG. 2 will be moved from its illustrated position to its non-illustrated position, thereby separating shift register 12 into two portions 12.1 and 12.2. The shift register stages in section 12.1 correspond to locations upstream of the flip-over region, whereas those of section 12.2 correspond to locations downstream of the flip-over region.

Activation of pushbutton 16 connects the two information outputs of the fifth shift register stage of section 12.1 to the two information inputs of an intermediate shift register 17 having an input 18 for the receipt of shifting pulses. The three outputs of intermediate shift register 17 are, in the embodiment of FIG. 2, permanently connected to the corresponding inputs of the first shift register stage in section 12.2.

The introduction of the four additional intermediate stages 17 into the shift register 12 can be made to compensate for the above described phase shift resulting from a changeover of machine operating mode.

Variation 1.1

According to this approach, the shifting signal inputs 14 and 18 are joined together, so that intermediate shift register 17, very simply, is plugged into the middle of shift register 12, converting an eleven stage shift register into a fifteen stage shift register. The number of stages in the intermediate shift register 17 should equal the phase shift to be compensate, expressed in degrees of angular rotation of the roller 8 relative to the roller 5, divided by the number of degrees of angular rotation of the rollers 5 and 8 corresponding to the time interval between successive synchronizing pulses.

For example, if the changeover from one-side printing to two-side printing introduces a phase shift of 130°, and if the rollers 5 and 8 rotate 30° per synchronizing pulse, then the number of stages in the intermediate shift register 17 should be 130 divided by 30 = 4, the non-integral remainder being ignored. Evidently, with this compensation approach, 10° of the introduced phase shift will not in fact be compensated. Only 120° of the introduced phase shift will be compensated. It is possible to compensate the remaining 10° of phase shift by applying to the enabling signal input 19 of bistable device 13.2 (FIG. 2) a properly timed enabling signal. If the enabling signal is 10° out of phase with the synchronizing signals, then although a signal corresponding to a particular sheet will be entered into the respective shift register stage contemporaneously with a synchronizing shifting pulse, nevertheless the information thusly entered will not become effective to actuate the respective functional group of the printing machine until after another 10° of roller rotation has occurred. To generate an enabling signal which is 10° out of phase with respect to the synchronizing signal (i.e., as measured with respect to degrees of rotation of the rollers), the synchronizing signals, i.e., the shifting pulses applied to inputs 14 and 18, can be applied to a delay stage which introduces a fixed time delay equal to the time required for the rollers 5 and 8 to turn through 10°. Alternatively the generation of two trains of synchronizing pulses phase shifted relative to each other by an amount corresponding to 10° of roller rotation can be effected by suitably adjusting synchronizing disks D1 and D2, as explained with respect to FIG. 1*b*.

Variation 1.2

If the non-integral remainder referred to under Variation 1.1 (10° in that example) is sufficiently small, it is possible to leave such remainder altogether uncompensated. As a further alternative it would be possible to introduce the required compensation in a mechanical manner, by suitable adjustment of the mechanical portions of the actuated functional groups, if such functional groups are adjustable in that manner. In either case, the arrangement would be the same as shown in FIG. 2, except that the enabling gate 19 of bistable device 13.2 would be dispensed with.

Variation 1.3

According to this possibility, different shifting pulses would be applied to the shift pulse inputs 14 and 18. The pulses applied to the input 14 would be the synchronizing shifting pulses already mentioned, whereas the pulses applied to input 18 would correspond to the pulses applied to input 14 but would be phase shifted with respect to the latter by a time interval corresponding to 10° of roller rotation, i.e., by a time interval corresponding to the non-integral remainder of the quotient mentioned before. The generation of this second series of shifting pulses, phase shifted by 10° with respect to the first series, can be accomplished by applying the first series of shifting pulses not only to the input 14 but also to the input of a delay stage having an output connected to input 18 and being adjusted for a time delay corresponding to 10° of roller rotation. Alternatively, two trains of synchronizing pulses phase shifted to the extent necessary can be produced as described with respect to FIG. 1*b*.

Variation 2

Figure 3:
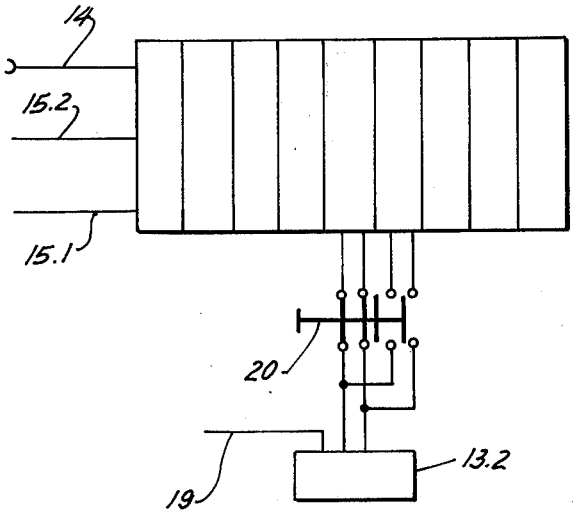
FIG. 3 illustrates a second control system according to the invention.

According to this approach, the phase shift introduced when changing over between one-side and two-side printing is compensated by changing the shift register stage to which is connected the bistable interrogating device that actuates the respective functional group of the printing machine. This approach is illustrated in FIG. 3. In FIG. 3 a switch 20 can be moved to one or the other of its two positions to connect the two inputs of the associated bistable interrogating stage 13.2 to the corresponding two outputs of either the fifth or the sixth shift-register stage of the illustrated shift register.

Variation 2.1

According to this approach the connection of the bistable interrogating stage 13.2 is shifted or translated by a number of shift register stages equal to the integral quotient of the introduced phase shift, expressed in degrees of roller rotation, divided by the period between successive synchronizing shifting pulses, also expressed in degrees of roller rotation, with any non-integral remainder being initially ignored. The non-integral remainder can be offset by applying to the enabling gate 19 of the bistable interrogating stage 13.2 an enabling pulse delayed relative to the shifting pulses applied to shifting pulse input 14 by a time period corresponding to the non-integral remainder just mentioned. Such a delayed enabling pulse can be generated by applying the train of synchronizing shifting pulses not only to shift-register input 14, but also to the input of a time delay stage set for a time delay period corresponding to the non-integral remainder just mentioned. The enabling pulses applied to input 19 can also be derived from one of the units PE1, PE2 in FIG. 1*b*.

Variation 2.2

If the non-integral remainder mentioned above is very small, it may be possible simply to ignore it altogether, and not attempt to offset it or compensate for it. As a further alternative, and instead of modifying the shift register control circuitry in the ways explained above, it would be possible to adjust the functional groups controlled by the control circuitry in such a manner as to take into account the non-integral remainder in question. This of course would be a possiblity only if such functional groups are so constructed as to be adjustable in that manner. As an example of the kind of adjustment in question, the electromagnetic moving means for a functional group to be adjusted (e.g., moving means 13.2' or 13.2'') could be so adjusted that its pull-in or energization time was appropriately increased or decreased. If this approach is used, then the bistable interrogating stage 13.2 in FIG. 3 can be simplified by removal of its enabling input 19, with use being made instead of a simple flip-flop having one of its two flip-flop outputs connected to one or more electromagnetic moving means of one or more functional groups of the printing machine.

Variation 3

Figure 4:
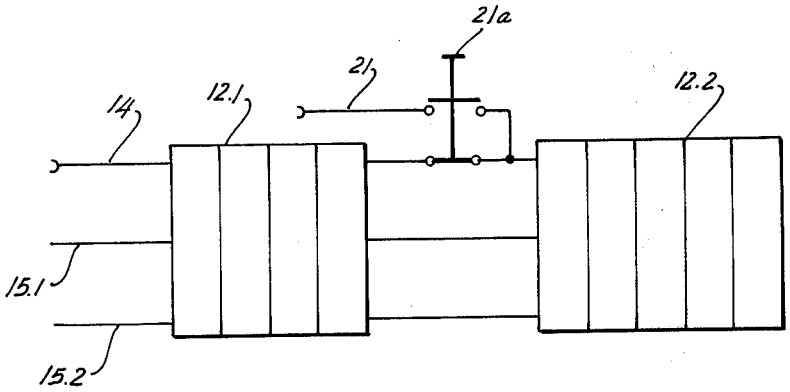
FIG. 4 illustrates a third control system according to the invention.

This approach is depicted in FIG. 4. When the printing machine is changed over from one-side printing to two-side printing, the button 21a shown in FIG. 4 is depressed, thereby separating the shift register 12 into two sections 12.1 and 12.2. Specifically, the two information signal outputs of the last shift-register stage of section 12.1 remain connected to the corresponding two inputs of the first shift-register stage of section 12.2, but the shifting pulses input for section 12.2 is now connected to a separate input line 21, for the receipt of synchronizing shifting pulses different from those applied to the input 14 of the first shift register section 12.1. The shifting pulses applied to input 14 will be the same as those mentioned previously, whereas those now applied to input 21 will be delayed in time, relative to the pulses applied to input 14, by a time period corresponding to the phase shift introduced as a result of the changeover from one-side to two-side printing. Using the exemplary numerical values employed above, it will be assumed that the changeover from one-side printing to two-side printing requires a relative rotation of the rollers 5 and 8 by 130°. The time shift between the shifting pulses applied to inputs 14 and 21 in FIG. 4 should accordingly be equal to the time required for the rollers mentioned to turn through an angle of 130°.

The generation of the synchronizing shifting pulses applied to input 21 in FIG. 4 can be achieved in several ways. As one possibility, the shifting pulses applied to input 14 can furthermore be applied to the input of a time-delay stage having an output connected to shifting pulse input 21, and with the time-delay stage being set for a time delay corresponding to the phase shift to be offset, assumed for purposes of explanation to correspond to the time required for the rollers 5, 8 to turn through an angle of 130°. Alternatively, the synchronizing arrangement of FIG. 1*b* can be used.

Referring again to the control circuit in FIG. 4, upon changing over from one-side printing to two-side printing, and/or upon a change of the length of paper processed in the case of two-side printing, the phase shift of 130° discussed above in the relative positions of the rollers 5, 8 is compensated by disengaging clutch C5, rotating synchronizing disk D2 by an amount sufficient to produce a second train of synchronizing pulses offset by 130° relative to the pulses produced from disk D1, and then re-engaging clutch C5. The synchronizing pulses generated at the output of photoelectric detector unit PE1 will be applied to input 14 in FIG. 4 while the synchronizing pulses generated at the output of photoelectric detector PE2 will be applied to input 21 in FIG. 4.

As described previously, the introduction of a sheet into the printing machine can be positively ascertained by provision of a photoelectric or other detector unit at such point of introduction. The particular signal associated with a particular introduced sheet passes along the successive stages of the shift register 12 in synchronism with the passage of the sheet through the printing machine. It is to be noted, however, that the arrival of the signal associated with a particular introduced sheet at a particular shift-register stage is evidently not an absolute indication that the sheet has in fact reached the corresponding location in the path of travel of sheets through the machine; it is only assumed that such is the case. If it is desired to positively ascertain that the sheet has in fact reached a particular location in the printing machine, additional detectors can be provided at selected locations along the path of travel of sheets through the machine, and these additional detectors can be combined with the shift register control circuitry already described.

Figure 5:
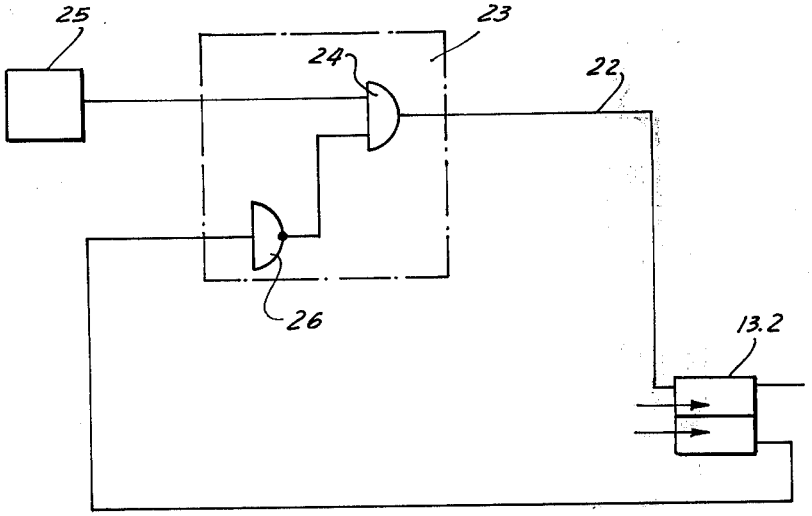
FIG. 5 illustrates an auxiliary stage which can be used with any of the three control systems shown in FIGS. 2–4.

FIG. 5 shows one possibility.

The bistable interrogating stage 13.2 of FIG. 5 is the same as previously described and serves the same function, being connected to one stage of the shift register 12, in the manner described previously. In FIG. 5, the interrogating stage 13.2 is a simple flip-flop. A control stage 23 is connected to one input of flip-flop 13.2 and to one output thereof. The control stage is comprised of an AND-gate 24 having an output 22 connected to the first flip-flop input. AND-gate 24 has a first input connected to an additional sheet detector 25 positioned at an appropriate location along the path of travel of sheets through the printing machine, e.g., at the location associated with the shift register stage to which flip-flop 13.2 is connected. The second input of AND-gate 24 is connected to the output of an inverter 26, the input of which is connected to the second output of flip-flop 13.2.

The arrangement of FIG. 5 operates as follows:

Interrogating flip-flop 13.2 has on its left side (as seen in FIG. 5) two inputs, and has on its right side two outputs, each output being associated with the respective input in the conventional flip-flop manner. The two flip-flop inputs are connected to the corresponding two outputs of one of the shift-register stages of shift-register 12. If the particular shift-register stage registers the assumed presence of a sheet at the associated location in the printing machine, then the lower input of flip-flop 13.2 is triggered. The corresponding flip-flop output is connected to the respective functional group of the printing machine, e.g., is connected to the electromagnet moving means 13.2'' in FIG. 1 and energizes such electromagnet means. This flip-flop output is furthermore connected to the input of inverter 26. In the event that the flip-flop 13.2 registers the assumed presence of a sheet at the associated location, whereas the sheet detector 25 actually positioned at such location detects the absence of a sheet, then the signals applied to the inputs of AND-gate 24 will be the same, and the upper input (as viewed in FIG. 5) of flip-flop 13.2 will be immediately triggered, preventing the lower flip-flop output from energizing the respective electromagnet moving means. This mode of operation is evidently advantageous, For instance, if the flip-flop interrogator 13.2 registers the assumed presence of a sheet at the associated location in the printing machine, whereas in fact no sheet is present, then it would be very important to prevent, for example, engagement of a dampened offset roller and a printing cylinder not carrying a sheet to be printed.

In the explanation of the foregoing different compensating techniques for offsetting the lack of synchronization resulting from a changeover from one-side to two-side printing, the lack of synchronization was expressed in degrees of rotation of the rollers 5, 8 and 10. This was particularly convenient to do, inasmuch as these rollers were all of the same diameter and driven at the same rotational frequency. It is evident, however, that such need not be the case. For instance, the diameters of the three rollers 5, 8, 10 could be related to each other by integral multiples; for example, the diameter of roller 8 could be twice the diameter of roller 5, and the diameter of roller 10 could be three times the diameter of roller 5, with the larger rollers being provided with additional gripper and flip-over devices. Likewise, although in the illustrated embodiment the transporting of the sheet 6 through the printing machine was effected solely by cylindrical rollers, other conveyor means can of course be used, such as for example conveyor belts in combination with rollers, etc. Because of the various forms which the printing machine may have, and for the sake of greatest generality in defining the lack of synchronization resulting from a changeover from one-side to two-side printing, it is advantageous to define the phase shift discussed above not in terms of degrees of roller rotation, but rather in terms of the absolute change of the length of the path travelled by the sheets. As is clear from FIG. 1, and as explained in detail above, the total path length for sheets travelling through the illustrated printing machine is greater in the two-side printing mode than in the one-side printing mode. It is to be emphasized, however, that the machine could be so constructed that the total path length for sheets travelling through the printing machine would be greater in the one-side printing mode, all this depending upon the manner in which the sheet transporting elements are adjusted relative to each other in changing back and forth between the two operating modes.

It will be understood that each of the elements described above, or two or more together, may also find a useful application in other types of circuits and constructions differing from the types described above.

While the invention has been illustrated and described as embodied in a rotary printing machine adapted for both one-side and two-side printing, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore such adaptations should and are intended to be comprehended within the meaning and range of equivalence of the following claims.

What is claimed as new and desired to be protected by Letters Patent is set forth in the appended claims.

1. In a printing arrangement operative in a first mode for printing on only one side of a sheet and operative in a second mode for printing on both sides of a sheet, of type comprised of drive means for effecting transport of a sheet to be printed along a predetermined path through the printing arrangement, further comprised of a plurality of printing devices cooperating to effect printing of a sheet passing along said path, and further comprised of means operative for effecting a changeover from one to the other of said modes in a manner altering a portion of and changing the length of said path, a control system for the printing arrangement, comprising, in combination, a shift register having a plurality of shift register stages and having a shifting pulse input for receipt of shifting pulses and having an information signal input for receipt of information signals; means for applying to said information signal input a predetermined signal in response to the arrival of a sheet at a predetermined location along said path; shifting pulse generating means synchronized with said drive means and operative for applying to said shifting pulse input a train of synchronizing shifting pulses causing said predetermined signal to be registered by successive ones of said shift register stages in synchronism with the travel of the sheet along said path; a plurality of actuating means each associated with and controlling the operation of a respective one of said printing devices and each connected to a respective one of said shift register stages and each operative for actuating the respective printing device in response to the arrival of said predetermined signal at the respective shift register stage so as to control the operation of the respective printing device in a manner correlated with the arrival of the sheet to be printed at the portion of said path associated with the respective shift register stage; and compensating means operative upon a change of operating mode for at least partially offsetting changes in the correlation between shift register stages of said shift register and the associated portions of said path.

2. The arrangement defined in claim 1, wherein said compensating means comprises means for introducing into said shift register a number of intermediate additional shift register stages to compensate for the increase in the length of said path resulting from a change of operating mode.

3. The arrangement defined in claim 1, wherein said shifting pulse generating means comprises means for generating a train of synchronizing shifting pulses separated from each other by time intervals corresponding to the time interval required for a sheet to travel a predetermined distance along said path, and wherein said compensating means comprises means for introducing into said shift register a number of intermediate additional shift register stages equal to the distance by which said path is increased upon a changeover of operating mode, divided by the distance a sheet is transported along said path by said drive means during the time interval between two successive shifting pulses, minus any non-integral remainder in such quotient.

4. The arrangement defined in claim 1, wherein said synchronizing means comprises means for generating a train of synchronizing shifting pulses separated from each other by time intervals corresponding to the time interval required for a sheet to travel a predetermined distance along said path, and wherein said compensating means comprises means for separating said shift register into a first section comprised of respective first and last shift register stages and a second section comprised of respective first and last shift register stages, the last shift register stage of said first section having an information signal output and a shifting pulse output, and the first shift register stage of said second section having an information signal input and a shifting pulse input, an additional shift register comprised of respective first and last shift register stages, the first shift register stage of said additional shift register having an information signal input and a shifting pulse input and the last shift register stage of said additional shift register having an information signal output and a shifting pulse output, and means operative upon a change of mode of the printing arrangement for effectively inserting the shift register stages of said additional shift register intermediate the shift register stages of said first and second sections by so connecting said additional register to said first and second sections that the information signal input of the first shift register stage of said additional register is connected to the information signal output of the last stage of said first section, the information signal output of the last shift register stage of said additional register connected to the information signal input of the first shift register stage of said second section, and the shifting pulse output of said additional register connected to the shifting pulse input of the first shift register stage of said second section, whereby the compensation for the increase in the length of the path of travel of sheets through the printing arrangement associated with a change of operating mode is effected by causing said predetermined signal after it passes through the stages of said first section to pass through the stages of said additional register before arriving at the stages of said second section.

5. The arrangement defined in claim 4, wherein said shifting pulse generating means comprises means for applying to the shifting pulse input of the first stage of said additional register the same shifting pulses as are applied by said shifting pulse generating means to the shifting pulse input of the first stage of said first section.

6. The arrangement defined in claim 5, wherein the number of shift register stages in said additional shift register is equal to the change in length of said path associated with a change of operating mode, divided by the distance travelled by a sheet along said path during the time interval between two successive shifting pulses, minus any non-integral remainder in such quotient.

7. The arrangement defined in claim 6, wherein at least one of said actuating means is provided with enabling gate means having an enabling signal input for preventing such actuating means from controlling the associated printing device despite the arrival of said predetermined signal at the shift register stage to which such actuating means is connected until and unless an enabling signal is applied to said enabling signal input, further including means for applying to said enabling signal input a train of enabling signals having the signal repetition frequency of the train of shifting pulses generated by said shifting pulse generating means but time-delayed with respect to the latter by a time interval equal to said non-integral remainder multiplied by the time interval between successive shifting pulses.

8. The arrangement defined in claim 4, wherein the number of shift register stages in said additional shift register is equal to the change in length of said path associated with a change of operating mode, divided by the distance travelled by a sheet along said path during the time interval between two successive shifting pulses, minus any non-integral remainder in such quotient, and further including means for applying to the shifting pulse input of the first shift register stage of said additional shift register shifting pulses having the same pulse repetition frequency as the shifting pulses applied to the shifting pulse input of the first shift register stage of said first section but delayed with respect to the latter by a time interval equal to said non-integral remainder multiplied by the time interval between successive shifting pulses.

9. The arrangement defined in claim 1, wherein at least one of said actuating means is provided with enabling gate means having an enabling signal input for preventing such actuating means from controlling the associated printing device despite the arrival of said predetermined signal at the shift register stage to which such actuating means is connected until and unless an enabling signal is applied to said enabling signal input, and wherein said compensating means comprises means for applying to said enabling signal input a train of enabling signals having the pulse-repetition frequency of said train of synchronizing shifting pulses generated by said shifting pulse generating means but time delayed with respect to the latter in order to at least partially offset any change of correlation between shift register stages of said shift register and predetermined locations of said path resulting upon a change of operating mode.

10. The arrangement defined in claim 1, wherein said compensating means comprises means operative upon a change of operating mode for disconnecting at least one of said actuating means from the shift register stage to which it is connected and connecting such disconnected actuating means to a different shift register stage, in order to at least partially offset any change in the correlation between such actuating means and the associated portion of said path resulting from a change of operating mode of the printing arrangement.

11. The arrangement defined in claim 1, wherein said compensating means comprises means operative upon a change of operating mode of the printing arrangement for disconnecting at least one of said actuating means from the shift register stage to which it is connected and connecting such disconnected actuating means to a different shift register stage of said shift register, the two shift register stages to which such actuating means is alternatively connected being separated by $n$ intermediate shift register stages, where $n$ is equal to $(q - 2)$, $q$ being equal to the change in the length of said path associated with a change of operating mode, divided by the distance travelled by a sheet along said path during the time interval between two successive shifting pulses, minus any non-integral remainder in such quotient.

12. The arrangement defined in claim 11, wherein said at least one actuating means is provided with enabling gate means having an enabling signal input for preventing such actuating means from controlling the associated printing device despite the arrival of said predetermined signal at the shift register stage to which such actuating means is connected until and unless an enabling signal is applied to said enabling signal input, and further including means for applying to said enabling signal input a train of enabling signals having the signal repetition frequency of the train of shifting pulses generated by said shifting pulse generating means but time-delayed with respect to the latter by a time interval equal to said non-integral remainder multiplied by the time interval between successive shifting pulses.

13. The arrangement defined in claim 1, wherein said compensating means comprises means for separating said shift register into a first section comprised of respective first and last shift register stages and a second section comprised of respective first and last shift register stages, the last shift register stage of said first section having an information signal output and a shifting pulse output and the first shift register stage of said second section having an information signal input and a shifting pulse input, the information signal output of the last shift register stage of said first section being connected to the information signal input of the first shift register stage of said second section, and means operable when the printing arrangement is in one mode for connecting the shifting pulse input of the first shift register stage of said second section to the shifting pulse output of the last shift register stage of said first section and operable when the printing arrangement is in the other mode for disconnecting the shifting pulse input of the first shift register stage of said second section from the shifting pulse output of the last shift register stage of said first section, and means for applying to said shifting pulse input of said first shift register stage of said second section a train of shifting pulses having the same pulse repetition frequency as the train of shifting pulses generated by said shifting pulse generating means but delayed in time with respect to the latter by a time period equal to the time required for a sheet travelling along said path to move a distance equal to the change in the length of said path associated with a change of operating mode of the printing arrangement.

14. The arrangement defined in claim 1, wherein at least one of said actuating means comprises auxiliary sheet detector means operative for determining whether a sheet is present at the portion of said path associated with the shift register stage to which such actuating means is connected, and overriding means operative for preventing the actuating means from controlling the respective printing device, even if said predetermined signal is registered in the respective shift register stage, if said auxiliary detector means determines the absence of a sheet at the location corresponding to the respective shift register stage.

15. The arrangement defined in claim 14, wherein said actuating means is comprised of a bistable interrogating stage having a first input and an associated first output and having a second input and an associated second output, said overriding means comprising an AND-gate having an output connected to said first input, an inverter having an input connected to said second output and having an output connected to one input of said AND-gate, said AND-gate having a second input connected to said auxiliary sheet detector means, said first input of said interrogating stage being connected to the respective shift register stage for receipt of said predetermined signal, and said first output of said interrogating stage being connected to the respective printing device for controlling the operation thereof.

* * * * *